United States Patent [19]

Samuels

[11] Patent Number: 4,530,286

[45] Date of Patent: Jul. 23, 1985

[54] INTAGLIO PRINTING PLATE FOR PRINTING SERIAL MARKINGS

[75] Inventor: Gerard Samuels, Paoli, Pa.

[73] Assignee: RCA Corporation, Princeton, N.J.

[21] Appl. No.: 642,494

[22] Filed: Aug. 20, 1984

[51] Int. Cl.[3] ..... B41M 1/10; B41N 1/00

[52] U.S. Cl. ..... 101/395; 101/93.04; 101/163

[58] Field of Search ..... 101/170, 316, 163, 93.04, 101/93.05, 395; 400/121, 124, 125, 125.1

[56] References Cited

U.S. PATENT DOCUMENTS

| | | | |
|---|---|---|---|
| 2,129,065 | 9/1938 | Loop | 400/124 |
| 3,215,244 | 11/1965 | Hickerson | 400/81 |
| 4,060,031 | 11/1977 | Philipp | 101/163 |
| 4,129,390 | 12/1978 | Bigelow et al. | 400/121 |
| 4,174,182 | 11/1979 | Lendl | 400/124 |
| 4,183,683 | 1/1980 | Hiratsuka et al. | 400/122 |
| 4,288,167 | 9/1981 | Carson, Jr. et al. | 400/121 |
| 4,373,436 | 2/1983 | Shenoha | 101/316 X |
| 4,374,451 | 2/1983 | Miller | 445/22 |
| 4,396,303 | 8/1983 | Uddgren | 400/103 |
| 4,397,573 | 8/1983 | Thiel | 400/124 X |
| 4,437,775 | 3/1984 | Ochiai et al. | 400/124 |
| 4,473,008 | 9/1984 | Heyman | 101/170 |

*Primary Examiner*—Clifford D. Crowder

*Attorney, Agent, or Firm*—Eugene M. Whitacre; Dennis H. Irlbeck; LeRoy Greenspan

[57] ABSTRACT

An intaglio inking plate comprising a printing surface having an aperture therein, a plurality of separately-movable bars filling the aperture and means for positioning each bar separately either flush or depressed from the printing surface. The positioning means comprises (1) means for moving all of the bars to their flush positions, (2) means for blocking the further movement of selected ones of the bars, and (3) means for moving all bars that are not blocked to their depressed position.

11 Claims, 5 Drawing Figures

INTAGLIO PRINTING PLATE FOR PRINTING SERIAL MARKINGS

BACKGROUND OF THE INVENTION

This invention relates to a novel intaglio printing plate that is particularly useful for printing changeable markings, such as bar-code markings representing serial numbers, on nonabsorbent surfaces. With the novel plate, the depressed or intaglio areas can be changed with each impression or transfer.

In U.S. patent application Ser. No. 534,103 filed Sept. 20, 1983, by P. M. Heyman now U.S. Pat. No. 4,473,008, there is described an intaglio printing plate with the above-described characteristics. That prior plate includes a body having a plate surface with an aperture therein, and a plurality of separately-movable bars in the aperture. Each bar has a flat end that is movable to a first position flush with the plate surface and to a second position depressed a small distance below the plate surface. Each bar is moved by a separate solenoid through a mechanical linkage. In operation, the solenoids move the bars to the desired positions, the plate is inked and the ink pattern is transferred, and then the cycle is repeated.

Because of the large number of solenoids required and because of the characteristics of solenoids, only clusters of small solenoids with relatively-low power are practical. Also, the nature of the ink and the large amount of contacting surface require a better mechanical arrangement to provide longer life and less maintenance for the inking plate.

It was suggested that the other end of each bar opposite the flat end be an inclined plane or taper. A sliding blade, driven pneumatically or hydraulically and having a mating taper, would be used to drive selected bars upward to the flush position, and metal springs would be used to maintain nonselected bars in the depressed position and, also, to return selected bars back to the depressed position. Most of the same disadvantages apply to this arrangement. Also individual springs require separate setup and adjustment.

SUMMARY OF THE INVENTION

The novel intaglio printing plate is similar to the above-described prior plates except for the means for positioning the bars of the plate. The novel plate includes means for moving all of the bars to the flush position, means for blocking the further movement of selected ones of said bars and means for moving all of the bars that are not blocked to the depressed position. By this arrangement, a single means of much greater power is used to move the bars first to the flush positions and then to move selected bars to the depressed positions. Individual means of very low power and small size are used to block or unblock the movements of the bars. Also, by starting the positioning cycle with all bars in the flush position, all of the ink from any prior cycle can be cleared from the plate surface.

In a preferred arrangement, each bar is positioned in a stack and has a large hole therethrough. A rigid support having elastomeric pads on its upper and lower surfaces is positioned in the holes. A single upward movement of the support positions all of the bars in the flush position. A single movement of selected tapered sliding blades blocks the further movement of selected ones of said bars. A single downward movement of the support positions all of the nonselected bars in the depressed position. The elastomeric pads function as springs which act individually on each bar but do not have to be installed and adjusted individually for each bar.

DETAILED DESCRIPTION OF THE PREFERRED EMBODIMENT

Figure 1:
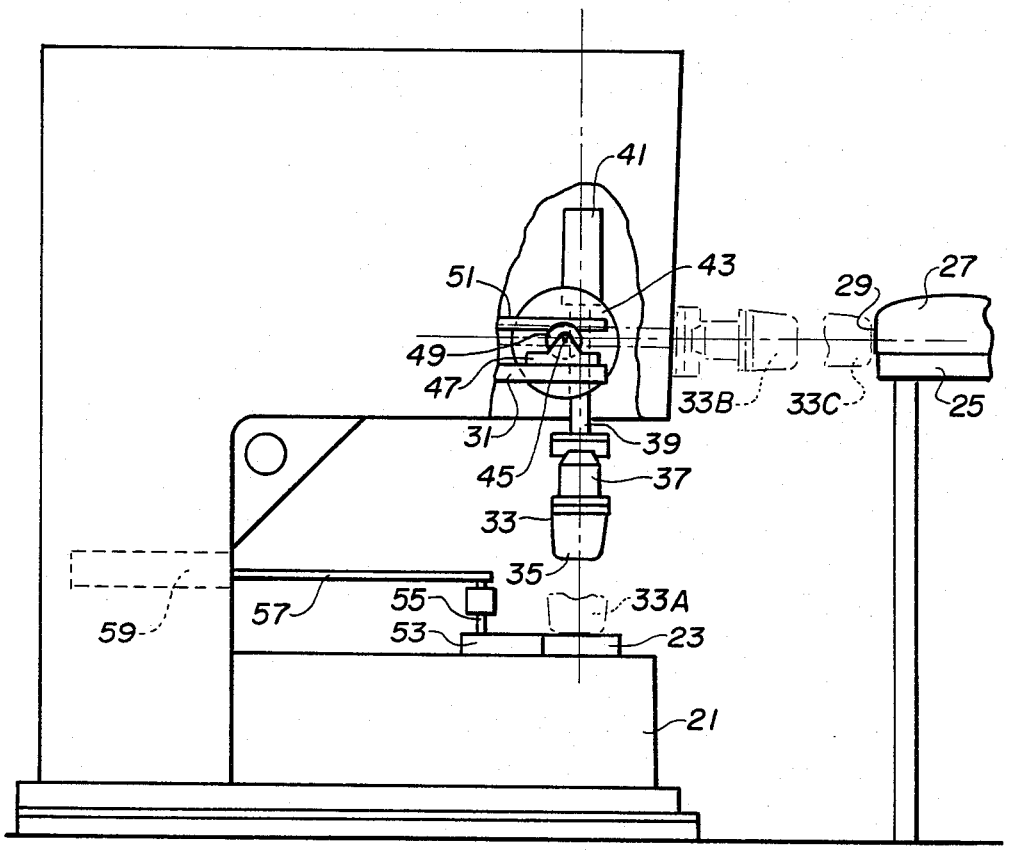
FIG. 1 is an elevational view of an apparatus for intaglio printing which includes the novel printing plate.

The steps for intaglio printing with the novel printing plate are exemplified below with reference to FIG. 1 by the forming and transfer of a bar-code marking from the printing plate to the sidewall of a glass faceplate panel of a color television picture tube. Such prior-art bar-code markings are described, for example, in U.S. Pat. Nos. 4,327,283 to P. M. Heyman et al. and 4,374,451 to W. R. Miller. Suitable pad-printing apparatus, except as noted below, is described in U.S. Pat. No. 4,060,031 to W. Philipp and the above-cited Heyman patent application. Other markings, both coded and uncoded, may be formed and transferred using the novel inking plate on other apparatus.

The apparatus shown in FIG. 1 comprises a first table 21 on which is mounted a novel intaglio inking plate 23 (described in detail below) and a second table 25 for holding a panel 27 in position with the sidewall surface 29 to be printed on facing sidewards toward the inking plate 23. A frame 31 supports a transfer assembly over the first table 21. The transfer assembly includes a resilient pad 33 made, for example, of a silicone polymer, having a generally-rectangular pad transfer surface 35 and a pad support 37. The pad support 37 is mounted on a first piston rod 39 that is operated from a first pneumatic cylinder 41, which is supported on a drum 43 having a hole therethrough that is offset from its axis of rotation and through which the first piston rod 39 extends. The drum 43 is supported from an axle 45 on pillow blocks 47 mounted on the frame 31. Attached to the axle 45 is a pinion 49, which is contacted by a rack 51, which is driven by a second piston rod and a second pneumatic cylinder (not shown). The second cylinder, through the rack 49 and pinion 51, can rotate the drum 43 through at least 90° to position the first piston rod 39 to move either vertically or horizontally. An inkwell or reservoir 53 is located on the first table 21 abutting the far side of the inking plate 23. A doctor blade and rake 55, attached to a third piston rod 57 and a third pneumatic cylinder 59, rests in the inkwell 53.

The apparatus is operated as follows, starting from the position shown in FIG. 1. The third cylinder 59 is activated to move the third piston rod 57 and doctor blade and rake 55 horizontally across the inking plate 23 and back to the initial position, whereby the rake spreads a quantity of ink across the inking plate 23, thereby filling the depressions therein with ink on the way out, and the doctor blade wipes the excess ink from the plate surface on the way back to the inkwell 53. Then, the first cylinder 41 is activated to move the pad 33 downward into contact with the inking plate 23 as shown by the first phantom lines 33A, and then upwards back to its initial position, carrying an ink pattern on its surface 35. Next, the second cylinder is activated to rotate the transfer assembly about 90° through the rack 51 and pinion 49, so that the pad 33 is in the position shown by the second phantom lines 33B, and the first piston rod 39 is adapted to move horizontally. With the transfer assembly in this position, the first cylinder 41 is activated to move the pad 33 with the ink pattern thereon from the second position 33B into contact with the receiving surface 29 of the panel 27 as shown by the third phantom lines 33C. The pad 33 is then drawn back to the second position 33B, leaving the ink pattern on the surface 29. The transfer assembly is then returned to its initial position ready to start another cycle after the panel 27 is removed and another panel is put in its place.

The apparatus shown in FIG. 1 may be used for ordinary prior pad printing wherein the inking plate has fixed depressions eroded or engraved therein. The apparatus also may be used with the novel inking plate described herein in which the depressions, or the arrangement of depressions, in the inking plate may be changed before and after each print transfer. To this end, the bottoms of at least some of the depressions in the inking plate are separately movable on demand between the level of the plate surface and a prescribed shallow distance below the plate surface. Except for the repositioning of the depression bottoms, the novel method is essentially the same as in the prior printing method disclosed in the above-cited Heyman patent.

Figure 2:
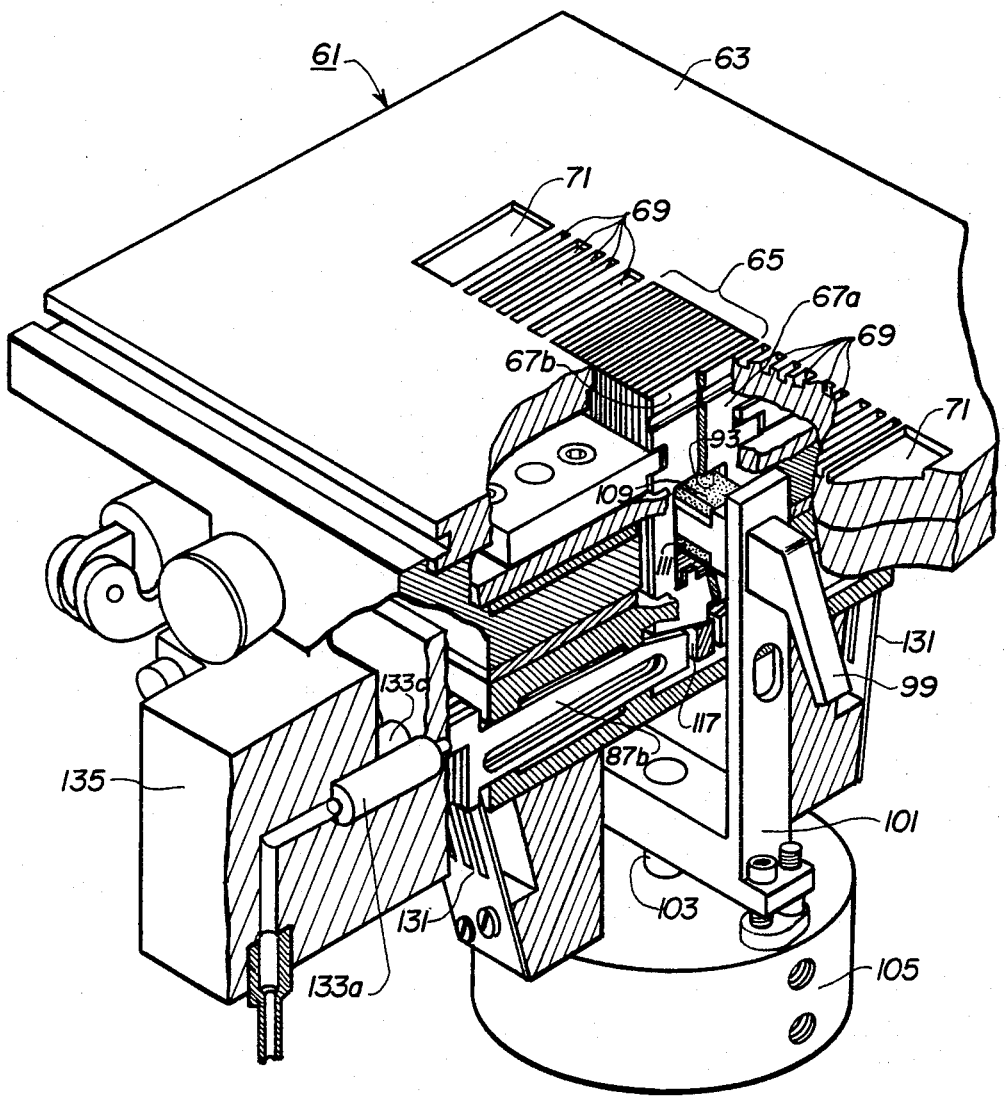
FIG. 2 is a perspective view partially broken away, of an embodiment of the novel printing plate.

In one form, shown in FIG. 2, the novel inking plate, which is adapted for printing "white" bars on a "black" background, comprises a plurality of bars in combination with adjustable mechanisms for positioning the bars separately up or down to form a prescribed pattern of depressions for ink. When "black" bars are to be printed on a "white" background, for the same coded marking, the positions of depressions and nondepressions are reversed. The inking plate shown in FIG. 2 is designed to form a marking that is 2 digits long in the interleaved two-of-five bar code. Since each digit requires nine unit widths, 18 movable unit-width bars are provided. The inking plate may be designed to form more than 2 digits; for example, 6 digits (54 bars) or 12 digits (108 bars). In addition, four units are required at one end to form the "start" of the marking, and five units are required at the other end of the marking to indicate the "end" of the marking. The "start" and "stop" units can be changeable, but since they do not change, they can be fixed; that is, etched or engraved in the inking surface. Also, additional fixed digits can be present just after the "start" and/or just before the "stop." The optimum amount of movement by the bars depends on the nature of the ink being used, but is ordinarily about 0.125 mm (5 mils).

Referring now to FIG. 2, the inking plate comprises a body 61 of metal having a surface 63 with a rectangular plate aperture 65 therein indicated by the bracket. The aperture 65 is blocked or closed by the flat ends of a stack of eighteen flat, platelike bars 67*a* . . . 67*r* each one of which is separately movable between a position that is flush with the plate surface 63 and a shallow distance below the plate surface. In addition, there are several barlike grooves 69 etched into the plate surface 63 at opposite ends of the aperture 65 for use as fixed "start" and "stop" indicators. When printing "white" on a "black" background, there is provided a depressed area 71 at each end of the bar-code structure equal in width to at least 10 unit widths to act as quiet zones.

Figure 3:
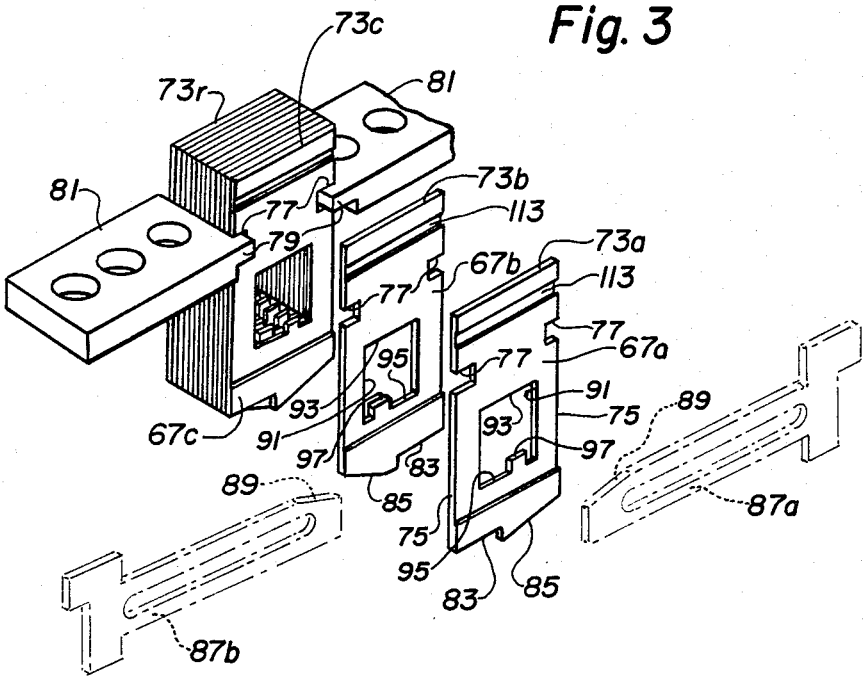
FIG. 3 is a perspective view, partially expanded, of the movable bar assembly of the printing plate shown in FIG. 2.

A detail of the stack of bars 67*a* . . . 67*r* and some of its associated structures is shown in FIG. 3. Each bar is about 0.025-inch thick by about 0.750-inch wide of air-hardened steel. The bars 67*a*, 67*b*, 67*c* . . . 67*r* are stacked against each other on their major surfaces which are ground to a flatness of ±0.0001 inch. This flatness permits the bars to slide independently against one another with no lubricant present with very little friction.

Each bar 67*a* . . . 67*r* has a flat upper end 73*a* . . . 73*r* respectively which is flush with the plate surface 63 when the bar is in the raised or flush position and which forms a well for ink when it is in the depressed position. The flat ends 73*a* . . . 73*r* each define a unit width (25 mils) and a unit height (750 mils) of the printed marking. Since the 2-of-5 bar code requires printed stripes of one-, two- or three-unit widths, one or two or three adjacent bars 67 are required to print (or not print) a desired stripe.

Each bar 67*a* . . . 67*r* has two straight parallel sides 75 extending down from its flat end 73*a* . . . 73*r*. Each side 75 has a rectangular slot 77 adapted for receiving the finger 79 of a stop plate 81. The vertical dimensions of the slots 77 and the fingers 79 are such as to permit each bar 67 to travel about 5 mils vertically. When a bar 67 is in the up or flush position, the flat end 73 is flush with the plate surface 63. When a bar 67 is in the down or depressed position, it forms a well about 5 mils deep for receiving printing ink.

Each bar 67*a* . . . 67*r* has a tapered lower end 83 with a tapered portion 85, which is a flat surface at an angle of about 7° from that of the flat upper end (about 97° from the intersecting side and about 83° from that of the other side 75). The angle of the tapered portion 85 alternates from side to side with successive, adjacent bars 67*a* . . . 67*r*. Each bar 67*a* . . . 67*r* has an associated, horizontally-sliding locking blade 87 with a tapered surface portion 89 matching the tapered portion 85 on its associated bar 67*a* . . . 67*r*. When it is desired to maintain a bar 67*a* . . . 67*r* in the flush position, the associated locking blade 87 is slid from its normal position towards the bar 67*a* . . . 67*r* so that the two associated tapered portions 85 and 89 are engaged.

Each bar 67*a* . . . 67*r* also has a rectangular hole 91 through its major surfaces defined in part by a flat upper contacting surface 93 closest and substantially parallel to the flat ends 73*a* . . . 73*r* and a lower surface 95 having a flat-ended projection 97 upstand toward the flat ends 73*a* . . . 73*r*. The positions of the projections 97 are off center and they alternate from side to side with successive, adjacent bars 67, and each projection is above the tapered surface portion 85 of the particular bar 67. When the bars 64*a* . . . 67*r* are in a stack, all of the flat upper contacting surfaces 93 and all of the flat ends of the projections 97 are essentially aligned with one another.

Figure 4:
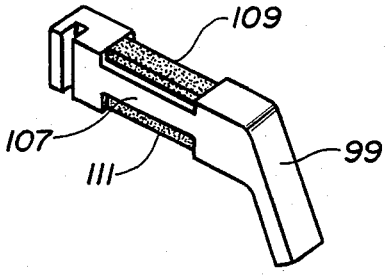
FIG. 4 is a perspective view of the elastomeric spring support bar assembly of the printing plate shown in FIG. 2.

As shown in FIG. 2, a rubber spring assembly 99 is positioned horizontally through all of the holes 91 of the bars 67*a* . . . 67*r*. The rubber spring assembly 99 is held in the upstanding arms of a yoke 101, which is connected to the power piston rod 103 of a pneumatic power cylinder 105 that is adapted to move the yoke 101 and the rubber spring assembly 99 vertically. The rubber spring assembly 99 shown in detail in FIG. 4 includes a rigid support 107, preferably of steel having an upper elastomeric spring pad 109 on its upper flat surface adapted to contact the upper contacting surface 93 of each bar 67*a* . . . 67*r* when the yoke 101 is raised, and a lower elastomeric spring pad 111 on its lower flat surface adpated to contact the upper surface of the projection 97 of each bar 67*a* . . . 67*r* when the yoke 101 is lowered. The upper and lower spring pads 109 and 111 are of rubber or synthetic elastomer of suitable durometer and act as upper and lower compression springs on each bar 67*a* . . . 67*r*. Using the spring pads 109 and 111 obviates the need for separate metal springs which require separate installation, adjustment and/or replacement. The effect of the lower spring pad 111 on the movements of adjacent bars 67 is avoided by offsetting from one another the positions of the projections 97 of adjacent bars 67.

Each bar 67*a* . . . 67*r* also has on one of its major surfaces a relief groove 113 that extends from side to side between, and spaced from, each of the flat ends 73*a* . . . 73*r* respectively and the upper contacting surface 93. The relief groove 113, which is about 30 mils wide and about 3 mils deep and may carry a thin layer of petroleum jelly on its surface, is effective to capture any ink that migrates between adjacent bars 67 from the flat ends 73, and prevents the ink from further migration, particularly into the holes 91 through the bars 67*a* . . . 67*r*. In one test with eighteen plates in the stack, substantially no ink migrated past the grooves after more than 27,000 cycles.

Figure 5:
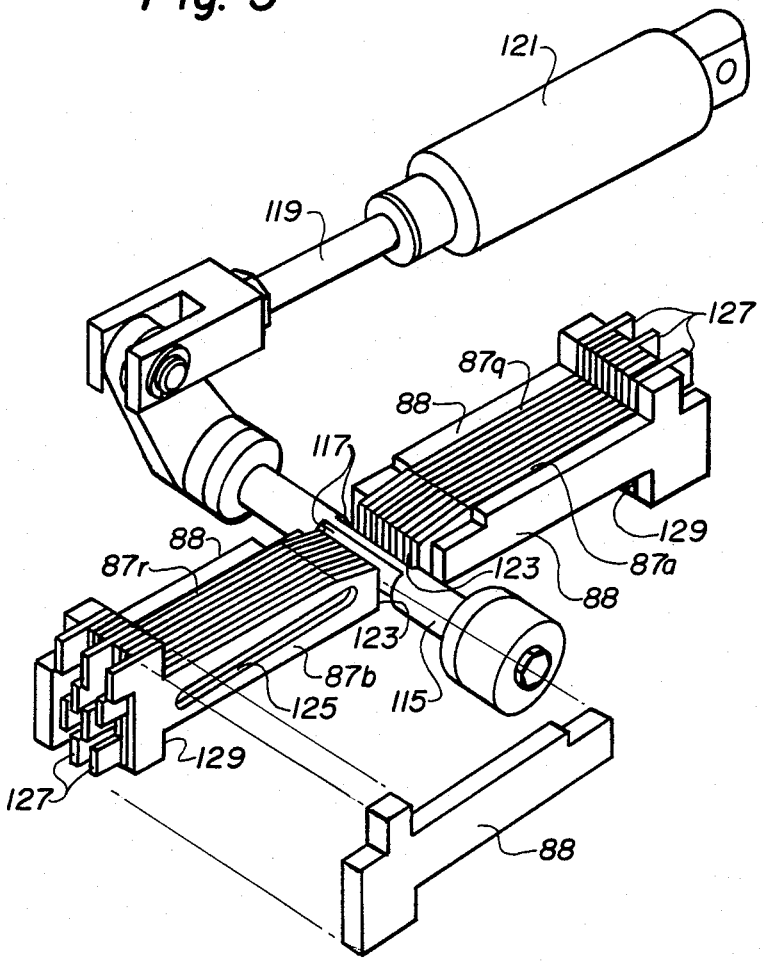
FIG. 5 is a perspective view, partially expanded, of the locking blade assembly of the printing plate shown in FIG. 2.

At the start of each printing cycle, the yoke 101 is forced up by the power piston rod 103, and the support 107 moves up causing the upper pad 109 to push all the bars 67*a* . . . 67*r* up into the flush position. The fingers 79 of the stop plates 81 guarantee accurate positioning of each of the bars 67 in the flush position. The override of the yoke 107 is absorbed by the upper spring pad 109. Prior to this, all of the locking blades 87 had been returned to their outward "unlocked" positions. As shown in FIG. 5, there are nine horizontally-slidable locking blades 87*a*–87*r*, one for each bar 67*a* . . . 67*r*, on each side of a cam shaft 115 having two flat vertical cam surfaces 117. When the cam piston rod 119 of a pneumatic cam rotation cylinder 121 is actuated, the cam shaft 115 is rotated pushing any locking blades 87*a* . . . 87*r* in the inward locked position back to the outward unlocked position.

The sliding blades 87*a* . . . 87*r* have flat inner ends 123 for engaging the cam surface 117, a lubricated slot 125 on one of their major surfaces and an outer end with an outer-facing outer surface 127 and an inner-facing outer surface 129. When the locking blades 87*a* . . . 87*r* are arranged in stacks, the inner ends and the inner-facing outer surfaces 129 are aligned with one another. The outer-facing outer surfaces 127 are offset from one another in a regular order, as shown in FIG. 5. Each stack of locking blades 87 is bounded by two spacer blades 88.

As shown in FIG. 2, each locking blade 87*a* . . . 87*r* is biased to stay in the outward position by a spring tine 131 anchored to the base of the inking plate and pressing outwardly with its extended end against the inner-facing outer surface 129. Each locking blade 87*a* . . . 87*r* may be slid selectively to the inner position by the piston rod of its associated pneumatic locking cylinder 133*a* . . . 133*r* respectively. The locking cylinders 133*a* . . . 133*r* are housed in two cylinder manifolds 135.

A typical cycle of operation is as follows. All printing bars 67*a* . . . 67*r* are pushed up by the action of the power cylinder 105 (1.8-inch piston diameter) with an approximate regulated force of 102 pounds at 40-psi regulated pressure. In this position, all bar ends 73*a* . . . 73*r* of the printing bars are flush with the top surface 63 of the printing plate, and they cannot print. Selected horizontally-sliding locking blades 87*a* . . . 87*r* are pushed towards the cam shaft 115 for those printing bars which are to stay up in the flush position (not print). This is accomplished by activating particular ones of the respective locking cylinders 133*a* . . . 133*r*. These locking blades positioned inwardly lock those printing bars in their flush (nonprinting) positions. The power cylinder 105 is then reactivated to move downward. This action causes the rubber spring assembly 99 to force down (5 mils) all those printing bars which had not been locked before by the action of the locking blades. This action is accomplished with 60-psi regulated pressure in the power cylinder 105 and a 0.030" overtravel.

The doctor blade and rake 55 then move horizontally from rear to front filling all cavities with glass-based printing ink from the ink reservoir. This ink is a U.V. curing transfer-printing ceramic (glass) pigmented ink. The doctor blade 55 then moves horizontally from front to rear wiping all ink clean from the plate surface 63 and those printing bars which remained in the up position. The pad 33 then makes solid contact (under high pressure) with the top surfaces 63 of the printing bars, transferring the ink from the wells formed by the depressed bars.

All locking cylinders 133 are then deactivated, causing their spring-activated piston rods to retract. The cam rotation cylinder is then activated to turn the return cam 90°. This action pushes all locking blades 87*a* . . . 87*r* outward from the return cam 115. The downward force of the lower spring pad 111 will then cause all printing bars 67 in the flush position into the depressed position. This completes the printing cycle, which normally takes approximately 7 seconds.

Some unique features of this design are:

1. The self-locking nature of the 7° taper—Those printing bars which have been locked in to the "flush" position by the horizontally-sliding locking bars 87*a* . . . 87*r* withstand the high downward-acting forces that are applied.

2. The upper and lower spring pads 109 and 111 of 90 durometer urethane have withstood 19,600 printing cycles in one test. The goal was a life of 10,000 cycles, or 3 work shifts. These spring pads are easily replaced (about 3 minutes) by simply sliding out the rubber spring assembly after unlocking it by a special interlock. If each printing bar 67*a* . . . 67*r* (up to 108) were actuated by an individual cantilevered flat spring (instead of rubber springs), the 25-mil pitch between printing bars would make alignment extremely difficult and unreliable.

3. The printing bars have a 3-mil-deep × 30-mil-wide groove 113 machined closely to the top of the printing surface to help prevent ink from migrating below that level.

4. The printing bars 67*a* . . . 67*r* are recessed by 3 mils 75% along their height to minimize friction forces between adjoining bars and to neutralize slight warpage of parts. This feature prevents one printing bar from influencing the vertical motion of its neighbors since the rubber springs are really the means through which the printing bars derive their motion.

5. The small locking cylinders 133*a* . . . 133*r* are held in two air cylinder manifolds 135 in such a way that their small piston rods will engage each horizontally-sliding locking blade 87*a* . . . 87*r* without interfereing with each other, despite a center-to-center distance of printing bars of only 25 mils. These manifolds 135 exhibit a further feature in that air hosing is connected to the manifold which through machined internal ducting connects with the individual cylinders. This makes for easy and trouble-free hose connections and permits precise alignment between piston rod and locking blade.

6. All locking blades 87*a* . . . 87*r* are biased towards their respective air cylinders by leaf springs 131 to prevent one locking blade from influencing its neighbor through friction when it is pushed "in" while its neighbors remain "out."

7. Printing bars 67*a* . . . 67*r* have raised projections 97 on the lower edge of the rectangular holes therein. The projections are positioned in such a way that each is displaced from its neighbor alternately right and left. These projections 97 make contact with the lower spring pad 111. This unique pad 111 feature "decouples" the action of the spring pad 111 from the printing bars 65, i.e., it nullifies the sliding influence of each printing bar upon its neighboring bar.

What is claimed is:

1. An intaglio inking plate comprising a body having a major surface with an aperture therein, a plurality of separately-movable bars in said aperture, each bar having two flat substantially-parallel opposed major sides and a flat end that is movable between a first position flush with said major surface and a second position depressed a small distance below said major surface, and means for positioning each of said bars to said flush position or said depressed position, said positioning means comprising (a) means for moving all of said bars to said flush position, (b) means for blocking the further movement of selected ones of said bars and (c) means for moving all bars that are not blocked to said depressed position.

2. The plate defined in claim 1 wherein each of said bars has a hole therethrough, and all of said bars are stacked on the major sides thereof with the holes therein aligned with one another.

3. The plate defined in claim 2 wherein each of said holes includes a first boundary portion opposite said flat end, and said means (a) includes means for applying a moving force thereto for moving each bar to said flush position.

4. The plate defined in claim 3 wherein said means for applying a moving force to said first boundary portion includes a rigid backing member through the holes in said bars, an elastomeric pad between said backing member and all of said first boundary portions of said holes, and means for moving said backing member towards said major surface with force sufficient to move said bars to said flush position.

5. The plate defined in claim 1 wherein each bar has a tapered end opposite said flat end, and each blocking means includes a slidable locking blade having a tapered surface matching said tapered end and means for selectively moving each locking blade to a blocking position wherein said tapered surface is in contact with said tapered end or to an unblocking position.

6. The plate defined in claim 5 wherein each locking blade is slidable in a direction that is transverse to the direction of movement of its associated bar.

7. The plate defined in claim 2 wherein each of said holes includes a second boundary portion remote from said flat end, and said means (c) includes means for applying a moving force to said second boundary portion for moving each unblocked bar to said depressed position while leaving each blocked bar in said flush position.

8. The plate defined in claim 7 wherein said means for applying a moving force to said second boundary portion includes a rigid backing member through the holes in said bars, an elastomeric pad between said backing member and all of said second boundary portions of said holes, and means for moving said backing member away from said major surface with force sufficient to move said unblocked bars from said flush position to said depressed position, and said pad has sufficient resiliency to permit each blocked bar to remain in said flush position.

9. The plate defined in claim 8 wherein each second boundary position includes a projection upstanding towards said flat end, and the projections of adjacent bars are offset from one another.

10. The plate defined in claim 2 wherein all of said bars are stacked on the major sides thereof, and each bar has a groove in one side thereof extending between and spaced from each of said hole and said flat end thereof.

11. The plate defined in claim 10 wherein all of said bars are stacked on the major sides thereof with no lubricant therebetween, said sides having a flatness tolerance of $\pm 0.0001$ inch.

* * * * *